United States Patent [19]

Timell

[11] Patent Number: 5,005,274

[45] Date of Patent: Apr. 9, 1991

[54] MOUNTING DEVICE WITH TRANSFER MEANS FOR ADVANCING TUBULAR SLEEVES BETWEEN DIFFERENT WORK STATIONS

[76] Inventor: Hans Timell, Hasenbergstrasse 36, 6312 Steinhausen, Sweden

[21] Appl. No.: 399,460

[22] PCT Filed: Feb. 1, 1988

[86] PCT No.: PCT/SE88/00031

§ 371 Date: Sep. 5, 1989

§ 102(e) Date: Sep. 5, 1989

[87] PCT Pub. No.: WO88/07494

PCT Pub. Date: Oct. 6, 1988

[30] Foreign Application Priority Data

Apr. 3, 1987 [SE] Sweden ..... 8701396

[51] Int. Cl.[5] ..... B23P 23/00

[52] U.S. Cl. ..... 29/33 P; 29/33 T; 29/564.1; 29/711; 29/282

[58] Field of Search ..... 29/33 K, 33 P, 33 T, 29/564.1, 282, 430, 512, 564, 564.2, 711

[56] References Cited

U.S. PATENT DOCUMENTS 3,774,282 11/1973 Hooper ..... 29/282 X 3,874,048 4/1975 Millar et al. ..... 29/38.9 X 4,716,646 1/1988 Jarreby ..... 29/564.1

*Primary Examiner*—Steven C. Bishop

[57] ABSTRACT

The disclosure relates to an apparatus for the arrangement and preparation of cores (13) intended for use as reel cores in papermaking in a number of stations with tools for carrying out a number of working operations in and/or on each one of the ends of the cores (13), the stations being disposed in side-by-side relationship and having opening and closing grippers (16) for fixedly retaining the core (13) which is to be arranged and prepared, in each respective station during the execution of one or more working operations therein, the opening and closing grippers (16) being disposed on the one, free end of an arm (17) which is located at each end of the core (13) and which, at the opposite end in relation to the opening and closing grippers (16), is pivotal about a shaft (18) located beside the station. Furthermore, the arms (17), with the opening and closing grippers (16), are interconnected for simultaneous pivoting about the shaft (18) for transferring a core (13) substantially non-rotatably fixedly held by the grippers (16), from the above-mentioned station to the immediately subsequent station, in which open grippers (16) are arranged to be closed about the core (13) and thereby grasp and fixedly retain the core (13) in an orientationally controlled position before the preceding grippers (16) are opened for release of the core (13).

8 Claims, 5 Drawing Sheets

MOUNTING DEVICE WITH TRANSFER MEANS FOR ADVANCING TUBULAR SLEEVES BETWEEN DIFFERENT WORK STATIONS

The present invention relates to an apparatus for the arrangement, or preparation, of cores intended for use as reel cores in paper-making, in a number of stations, with tools for executing a number of working operations, for example expanding the inner diameter of the core by a milling machine or the like, providing a radial slot in the end edge of the core by means of a saw or slot milling cutter, orientation of end mountings, movement of the end mounting to the end of the core and expansion of the end mounting for fixation thereof in the end of the core, etc., in and/on each one of the ends of the cores, the stations being disposed in side-by-side relationship and being provided with opening and closing grabber claws or grippers for retaining that core which is to be prepared, in each respective station, during the execution of one or more working operations therein.

A previously known apparatus for the arrangement, or preparation, of cores for use as reel cores for winding up the paper web in paper-making is provided with a number of working stations for executing a number of working operations simultaneously on each one of the ends of the core. In the prior art apparatus, it is, int. al., necessary to execute an orientation of the core and, primarily, a rotational orientation of the core in each working station before the working operation proper may be commenced. Since the rotational orientation phase must be executed automatically, this not only entails an extremely complicated construction of each working station, but also implies a serious source of faults and deficient accuracy in the finished, end fitted cores. Not least as a result of these inconveniences, the prior art apparatus has failed to achieve any appreciable success on the market.

The task forming the basis of the present invention is to improve the prior art apparatus and, above all, to eliminate the requirement of execution of an orientation phase before the execution of a working operation in most of the different working stations.

This task is solved according to the present invention in the apparatus disclosed by way of introduction, in that the opening and closing grippers are disposed on the one, free end of an arm which is located at each end of the core and which, at the opposite end in relation to the opening and closing grippers, is pivotal about a shaft disposed beside the station; and that the arms with the opening and closing grippers are interconnected with one another for simultaneous pivoting about the shaft for transferal of a core substantially non-rotatably retained by means of the grippers from the above-mentioned station to the immediately subsequent station, in which open grippers are arranged to be closed about the core and thereby grasp and retain the core in an orientationally controlled position before the preceding grippers are opened for release of the core. The one arm located at one end of the core with its opening and closing grippers is reciprocally displaceable in relation to the other arm disposed at the opposite end of the core with its opening and closing grippers, for adaptation of the distance between the arms to accommodate the length of the core. The shiftable arm is coupled to a carriage which mounts the tool or tools for executing the working operations in and/or on the one end of the core and is in its turn displaceable on rails for adaptation to the length of each and every core, like the corresponding carriage in the other stations, in which the carriages in the subsequent stations are arranged to adjust in compliance with the carriage in the preceding station. The carriage is displaceable by means of a screw which is located on substantially the same level as the rails and proximal to the longitudinal axis of the core located in the working position. The stations are disposed in parallel with one another in such a manner that the travel between the centre of a core fixedly retained by the grippers and the centre of the pivotal shaft of the arms is equal in and between the stations. The pivotal shaft for the arms carries a gearwheel for cooperation with a rack with a piston and cylinder assembly at each end, these being interconnected for the positive simultaneous switching of the racks in one or the other direction for clockwise or counter-clockwise pivoting of the arms non-rotationally connected therewith. At one station, there is provided a conveyor for advancement of fittings to each core end, at which there is provided a reciprocally movable arm for one-by-one advancement of fittings from the conveyor to an initial position for rotational orientation of the fitting, in which a clamping device fixedly clamps the fitting for gripping by means of opening and closing grippers in the oriented position. The grippers are mounted on a frame which may be switched between a vertical position and an inclined position by the intermediary of a retainer pivotally mounted on the frame and longitudinally displaceable in the frame for transferring the fitting oriented in the initial position in the grippers to a position in register with the prepared core end for insertion therein and subsequent expansion therein by means of a mandrel.

The apparatus according to the present invention will wholly obviate the need of a working phase which rotationally orientates the core prior to the execution of a working operation in the different working stations The apparatus may, thereby, be rendered both simpler and more reliable Moreover, there will be attained a considerable shortening of the total working time required for the preparation of a core, by which is taken to mean the preparation, for example, expanding and slot milling of the ends of a core and provision of the ends of the core with a suitable per se known fitting preferably of metal. In the apparatus according to the present invention, the core is held throughout, from the first working station to the last working station, in an exact and retained rotationally oriented position, whereby the risk of deficient accuracy and orientation errors will be completely eliminated.

The nature of the present invention and its aspects will be more readily understood from the following brief description of the accompanying Drawings, and discussion relating thereto In the accompanying Drawings.

The apparatus according to the present invention shown on the Drawings is intended to provide tubular cores, preferably of board, intended for use as reel cores in paper-making, with per se known end fittings of metal or other suitable material. The cores may be of different lengths and the apparatus automatically adapts to the length of the supplied core. The apparatus according to the present invention shown on the Drawings and described herein has three working stations in which different working phases or working operations are carried out. According to FIG. 2, the apparatus of the present invention is provided with three mutually parallel working stations, of which the first is the working station located furthest to the left, in which the inner diameter of the core ends is expanded or flared by means of a milling or reaming machine, the second is the centremost working station in which an edge slot or groove is milled or sawed in the core edge by means of saw or slot cutter, and of which the third station is that located furthest to the right, in which an end fitting of metal is urged into the end of the core and expanded for fixation thereof in the core end. The practical execution of the different working operations in these separate working stations does not form part of the subject matter of the present invention and the present application, but may be carried out in a per se known manner and using per se known tools. On the other hand, the actual handling of the core between the different working stations and the fittings in the third working station fall within the scope of the present invention. It should, nevertheless, be emphasized that the tools for carrying out the working operations at the one end of the core are disposed on a carriage which is displaceable in the longitudinal direction of the apparatus or the machine, and thereby in the longitudinal direction of the working stations, for adaptation to the length of the core in question, while the tools for carrying out the working operations at the other end of the core are disposed at a fixed point. Naturally, there is nothing to prevent tools for both the one end and the other end of the core from being disposed on displaceable carriages which, hence are adjustable according to the length of the core.

Figure 1:
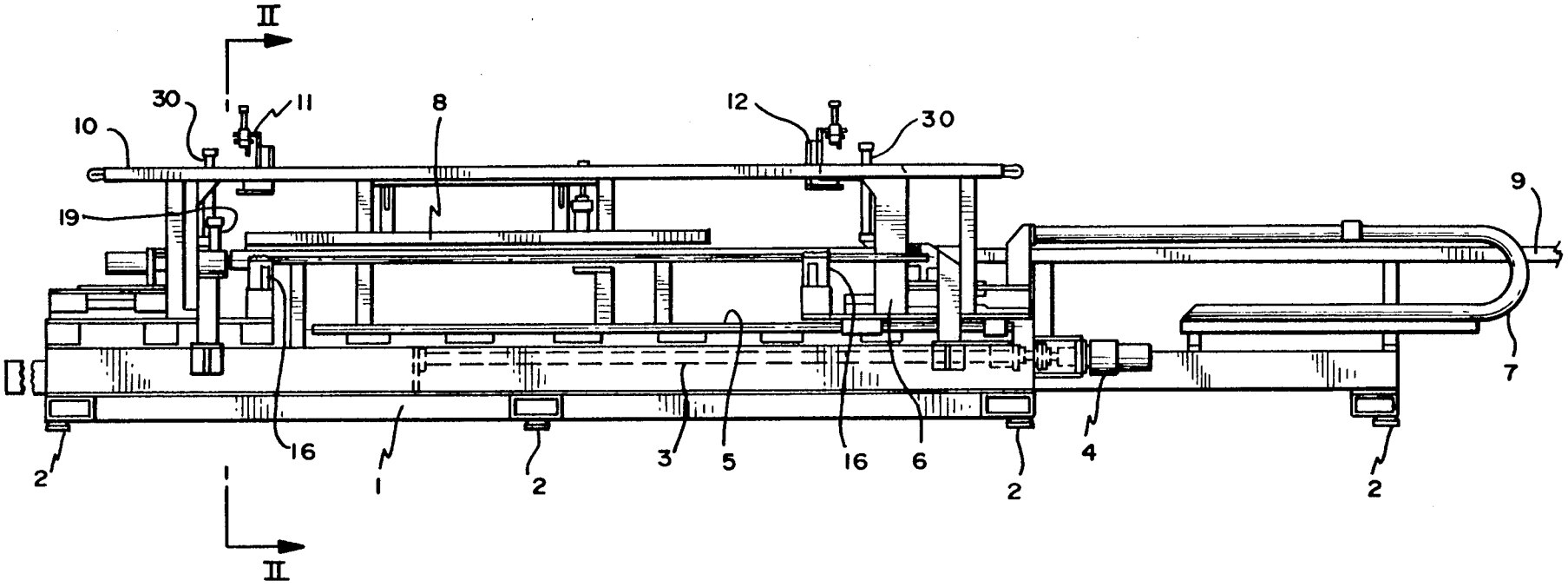
FIG. 1 is a side elevation of one embodiment of an apparatus according to the present invention.

The embodiment of the present invention shown on the Drawings is based on a frame 1 constructed of longitudinal and transverse square tubes, the frame resting on a substrate or bedding via so-called machine feet 2. The parts of the apparatus illustrated to the left in FIG. 1 are associated with the fixed portion, while the parts shown to the right in FIG. 1 are associated with the displaceable components of the apparatus, which are reciprocally shiftable towards and away from the fixed portions by means of ball screws 3 which are driven by motors 4, the moving parts being displaced on rails 5. The shiftable components associated with each working station are disposed on a carriage 6 which is in communication with the fixed frame 1 by the intermediary of a flexible cable carrier or cable gantry 7. Those cores which are to be arranged and prepared in the apparatus are advanced to an inserter or loader 8 on a conveyor 9 which extends from a core store or core magazine. The fittings which are to be applied in the ends of the cores are conveyed on a conveyor 10 to one fixed inserter 11 and one inserter 12 movable with the carriage 6.

Figure 2:
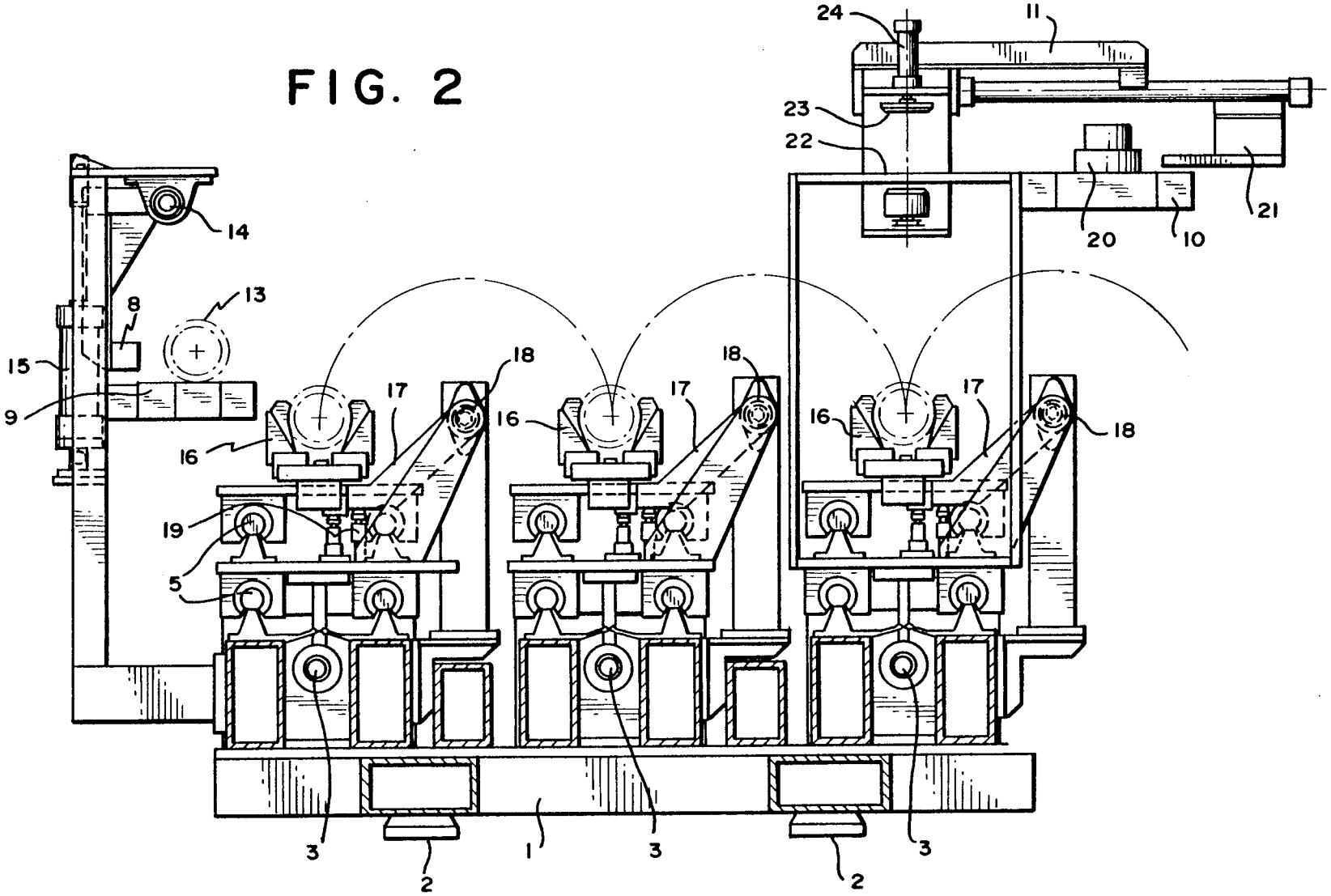
FIG. 2 is a section, on a larger scale, taken along the line II—II in FIG. 1, certain parts having been omitted for purposes of clarity.

FIG. 2 shows, by ghosted lines, that core 13 which is to be arranged, partly on the conveyor 9 and partly in the different working stations. The inserter 8 consists of a beam which, by the intermediary of two arms, is pivotally journalled on a shaft 14 which is rotatable by means of a piston and cylinder assembly 15. On pivoting of the beam 8 counter-clockwise, the core 13 is urged from the conveyor 9 down into the first working station in which opening and closing grippers 16 at either end of the core 13 are closed and grasp the core 13 in the position illustrated in FIG. 2. The opening and closing grippers 16 are disposed on the end of an arm 17 which, in its turn, is non-rotatably disposed on a shaft 18 provided with keys and keyways. The shaft 18 extends throughout the entire length of the working station. Beneath the opening and closing grippers 16, there are provided positional sensors for indicating the position of the opening and closing grippers, and thereby the arm 17. Naturally, the arm 17 is displaceable along the shaft 18 together with the carriage 6 for adaptation of their position to the length of the core 13.

Figure 3:
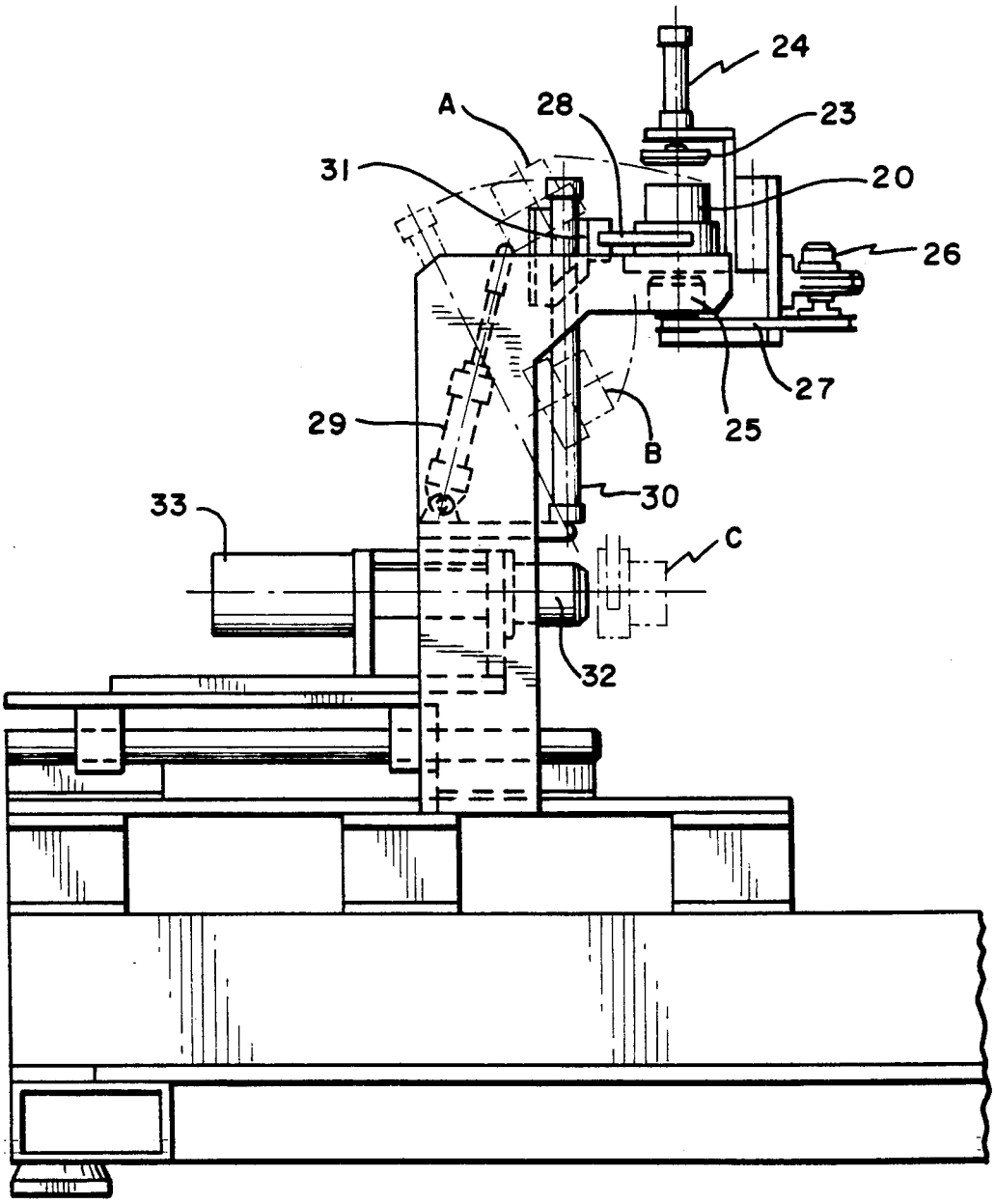
FIG. 3 shows, on the same scale as FIG. 2, a view of a portion of the left-hand end of the apparatus of FIG. 1, certain parts having been omitted for purposes of clarity also in this Figure.

As is apparent from FIG. 2, each working station, in the above-mentioned respects, is substantially alike. Thus, each working station is provided with opening and closing grippers 16 on an arm 17 which is non-rotatably, but shiftably disposed on the shaft 18 which extends throughout the entire length of the working station. For transferring the core 13 from one station to another and out of the final station, the shaft 18 is reciprocally pivotal through at least 180° by means of a gear rack connected to a piston and cylinder assembly 19, the gear rack being in engagement with a gear wheel coupled to the shaft 18 or a gear rim directly mounted on the shaft 18. The movable jaws in the grippers 16 are switched from open position to closed position and vice versa by means of a suitable piston arrangement. As soon as the grippers in the second working station are open and are located in the illustrated starting position, the arm 17 in the first working station may be pivoted clockwise through 180° for placing the core in the grippers 16 of the second working station, and, as soon as these have been closed, the grippers 16 of the first working station may be opened and, together with the arm 17 return to the position illustrated in FIG. 2 for receiving a new core 13 from the conveyor 9. When the working phases in the second station have been completed, the arm 17 of the second working station is pivoted to the third and last working station, on condition that the opening and closing grippers 16 therein are open and empty for receiving the core from the second working station. In this last working station, the core ends prepared in the preceding stations are to be provided with end fittings, as will be illustrated in greater detail below with particular reference to FIG. 3. The grippers 16, and possibly also the arms 17 in the different working stations as slightly mutually offset to avoid collision.

The inserters 11 and 12 are fundamentally alike, although being substantially mirror-inverted, and, according to FIG. 1, the inserter 12 is mounted on the carriage 6 which is displaceable in the longitudinal direction of the apparatus. End fittings 20 are conveyed on the conveyor 10 up to the inserters 11 and 12. Immediately ahead of the inserters 11 and 12, there are provided centering guides (not shown) for placing the end fittings 20 centrally on the conveyor 10. Once a fitting 20 has passed the inserter 11, its insertion piston 21 is switched into such a position on the conveyor 10 that the next end fitting 20 cannot pass, but can, with the assistance of, for example, magnets be grasped by the end of the piston 21 and moved on slipway 22 to the position shown by solid lines in FIG. 3. In this position, the end fitting 20 is fixedly clamped by means of a disk 23 on the end of a piston and cylinder assembly 24. The end fittings 20 are, as a rule, provided with a radial locking heel groove which is to fit in the edge slot provided on the core end, for which reason the end fitting 20 must be oriented into the position illustrated in FIG. 3. This orientation is effected by means of a rotary mandrel 25. This mandrel is provided with a resiliently sprung locking heel and is insertable in the end fitting 20. The mandrel 25 is rotated by a motor 26 by the intermediary of a belt 27. As soon as the resiliently sprung heel arrives at the recess or groove in the end fitting 20, the fitting will be caused to rotate with the mandrel 25, which is arranged so as to arrest at a predetermined exact position. When the mandrel 25 has ceased to rotate and come to rest with the end fitting 20 in a predetermined position and with the locking heel recess in a predetermined orientated position, opening and closing grippers 28 of substantially the same type as the grippers 16 are arranged to grasp the oriented end fitting 20 and retain it in the set oriented position.

The grippers 28 are mounted on a frame 30 pivotal by means of a piston and cylinder assembly 29 and the frame may be in the form of a piston and cylinder assembly. The opening and closing grippers 28 are further mounted in the frame 30 by means of pivotal arms 31 which are pivotal by means of a suitable motor or a suitable piston and cylinder assembly for placement of the end fitting 20 in the position B indicated by ghosted lines, once the frame has been pivoted, and switched the fitting 20 to the position A shown by ghosted lines. When the end fitting is located in the position B, the frame 30 is returned to the vertical position and the arms 30 are displaced with the grippers 28 and the end fitting 20 by means of the piston and cylinder assembly 30 to the position designated C. In position C, the end fitting 20 is located in alignment with the end of one core in the last working station and, in this position, can be urged into the end of the core by means of a mandrel 32 which is reciprocally displaceable by means of a motor 33 and is expandible for expanding the end fitting 20 when this is located in the correct position in the end of the core 13.

With an inserter 11 or 12 according to the foregoing, it is possible to achieve an extremely rapid handling of the end fittings 20. While one fitting 20 is located on the mandrel 32 and on its way to being urged into and expanded in the end of a core, the grippers 28 are returned to the starting position for gripping a new fitting which is oriented and fixed by the disk 23. As soon as a fitting 20 has been transferred to position A, a new fitting may be inserted from the conveyor 10 to the orientation position under the disk 23. Furthermore, the grippers 28 may be returned as soon as they have released an end fitting on the mandrel 32.

The core 13 on the conveyor 9 moves towards an end stop (not shown). A sensor unit on the carriage 6 in the first working station is provided with two sensors. If both are blocked, the carriage is moved towards the free end of the core 13. When the one passes the end, the carriage 6 is braked, to be entirely arrested when the other sensor passes free of the end of the core. When the grippers 16 in the first working station are closed, the carriage 6 in the second working station will be adjusted according to the carriage 6 in the first working with help of a sensor unit of the same type as that mentioned above and, as soon as it is in the correct position, pivoting of the shaft 18 is made possible for the first working station. When the grippers 16 of the second working station have grasped about the core, the grippers from the first working station are opened for releasing the core in the second working station and return to the starting position in the first working station. When they have reached starting position, immediate switching is made possible of the carriage 6 in the first working station to the length of the immediately subsequent core, while the core in the second working station is in the processing stage. When this core has been transferred to the third working station after positional adjustment of its carriage 6, the second working station is ready to receive a new core from the first working station. Thus, the working operations proper may be carried out in the different stations completely independently of one another. Interdependence between the working stations is only required on transfer of the core between them. Discharge of a finished core from the third station may possibly be executed with the assistance of other means than the grippers 16 on the arms 17 and the shaft 18.

Figure 4:
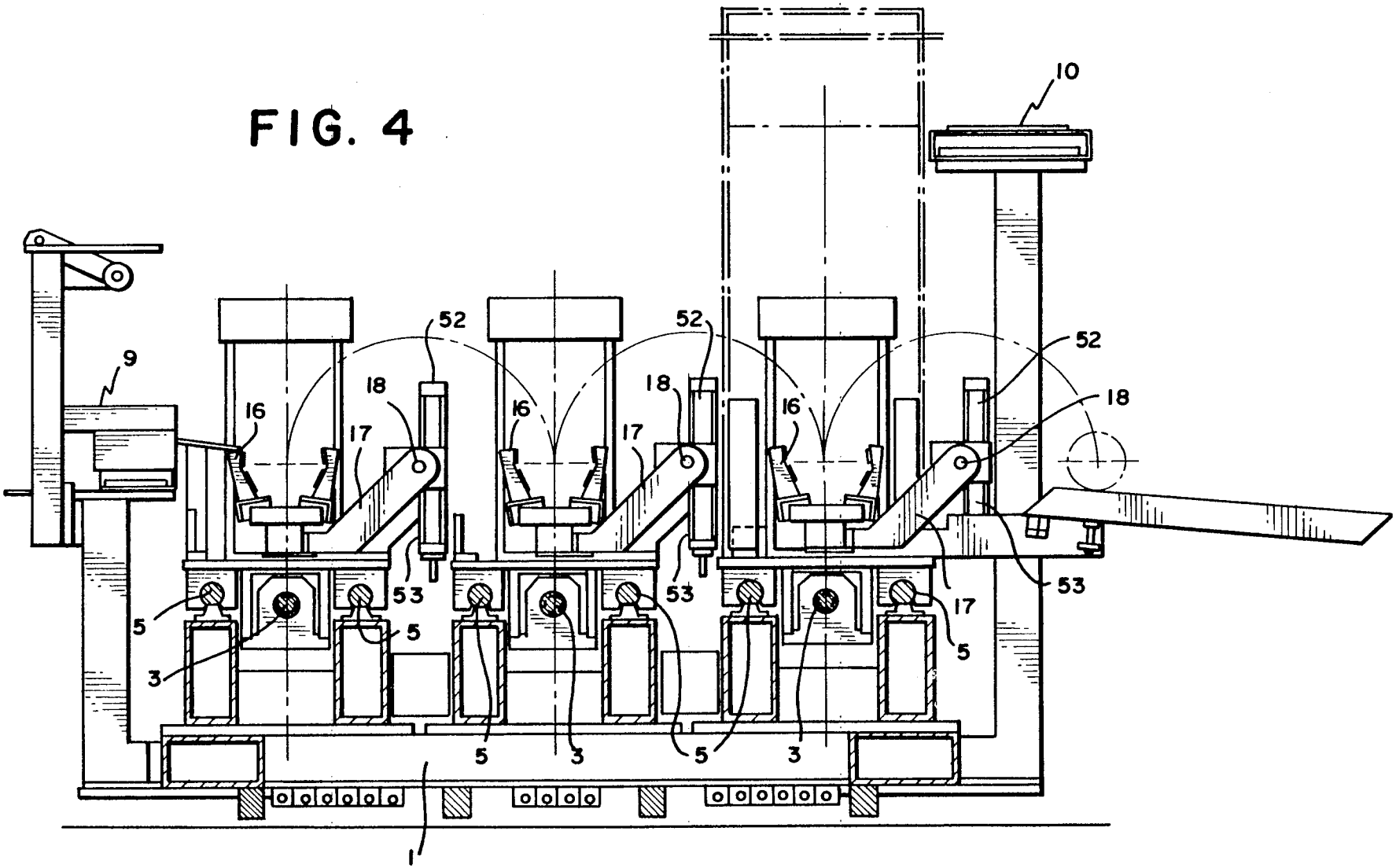
FIG. 4 shows a similar section to that of FIG. 2 of another embodiment of an apparatus according to the present invention.
Figure 5:
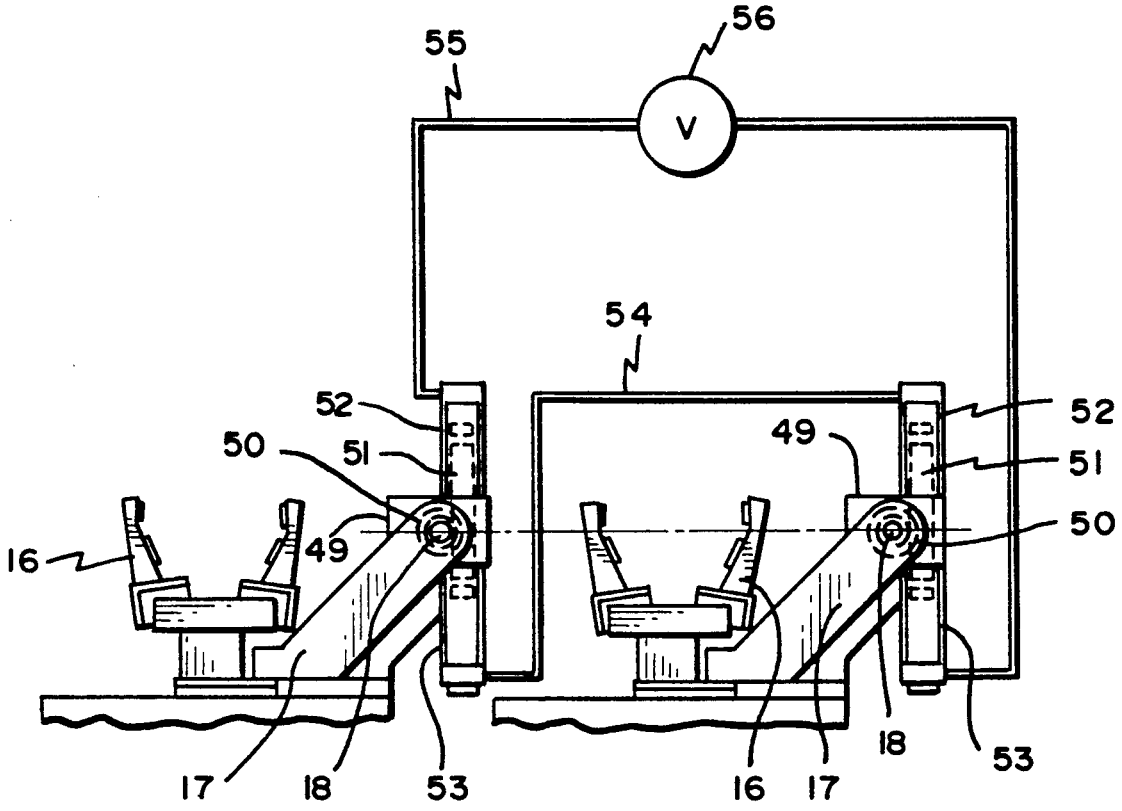
FIG. 5 is a coupling diagram of the arms in the embodiment according to FIG. 4.

The embodiment of the present invention illustrated in FIGS. 4 and 5 differs from the above-described embodiment essentially in that the shaft 3 and the rails 5 are located on substantially the same level and close to the longitudinal axis of the core 13, and in that the arms 17 are pivoted by means of other arrangements than in the above-described embodiment. By the disposition of the shaft 3 and the rails 5 close to the longitudinal axis of the core 13, the working phase arms will be considerably shorter, whereby the loadings will be less, which permits either lighter parts or greater processing speeds and greater processing forces.

In the embodiment illustrated in FIGS. 4 and 5, the shaft 18 of the arms 17 is rotatably journalled in a housing 49 and carries a gearwheel 50 which is in mesh with a gear rack 51 which is switchable by means of an upper piston and cylinder assembly 52 and a lower piston and cylinder assembly 53. The lower piston and cylinder assembly 53 for the arm 17 of the one core end is, by the intermediary of a conduit 54, in communication with the upper piston and cylinder assembly 52 of the arm 17 of the other core end, while the upper piston and cylinder assembly 52 for the arm of the other core end is, by the intermediary of a conduit 55 with a valve 56, in communication with the lower piston and cylinder assembly 53 of the arm 17 of the opposing core end. The valve 56 is coupled to a suitable source of a non-compressible pressure medium. The pistons in the piston and cylinder assemblies 52 and 53 are positively connected to the gear racks 51. The lower piston and cylinder assembly 53 and the upper piston and cylinder assembly 52 connected therewith, together with the conduit 54 therebetween, enclose a noncompressible fluid. In the conduit 54, some form of expansion chamber and replenishment device may possibly be provided. On switching of the valve 56 for pressurizing the piston and cylinder assembly 52, the valve 56 opens the conduit to the piston and cylinder assembly 53, whereby the gear racks 51 will commence to be driven downwardly into the piston and cylinder assembly 53 and rotate the gearwheels 50 for simultaneous positive pivoting of the arms 17 with the grippers 16 from one station to the immediately subsequent station. When the grippers 16 of the immediately subsequent station have been closed and grasp the arriving core 13, the grippers 16 on the arms 17 of the preceding station are opened to release the core and, after switching of the valve 56 to its opposite position, the conduit 55 is opened and the piston and cylinder assembly 53 is pressurized for switching the arms 17 back to their starting position. The conduit 54 between the lower piston and cylinder assembly 53 and the upper piston and cylinder assembly 52 and the non-compressible fluid located therein ensure the simultaneous pivoting of the arms 17 in an extremely simple and operationally reliable manner.

Many modifications of the apparatus according to the present invention are, naturally, conceivable without departing from the inventive concept as defined in the appended Claims. The piston and cylinder assemblies may be of different types, for example, pneumatic and/or hydraulic, while the motors may be electric or pneumatic and/or hydraulic. The positional sensors may be of many different types, such as, for example, photoelectric cells, magnetic, electromagnetic etc. However, all sensors are intended to generate and emit suitable signals to control equipment which may be programmed by means of a computer, this in itself being a technique well-known to persons skilled in this art.

I claim:

1. An apparatus for the arrangement and preparation of cores intended for use as reel cores inpapermaking, essentially comprised of:

one or more stations with tools for executing a number of working operations, wherein the stations are disposed in a side-by-side relationship; and said stations have openable and closable grippers for the retention of that core which is to be prepared in each respective station, under the execution of one or more working operations therein; and said stations have arms located at each end of the core, wherein said openable and closable grippers are disposed on the one free end of an arm, and with said arm being pivotal about a shaft at the opposite end from said grippers; and said arms being interconnected for the simultaneous pivoting about the shaft for he transfer of a core, being held substantially non-rotatable by means of the grippers, from an initial station to a subsequent station, in which the open grippers of he subsequent station are arranged to close about the core and thereby grasp and fixedly hold the core in an orientationally controlled position, before the grippers at the preceding station are opened for release of said core.

2. An apparatus for the arrangement and preparation of cores according to claim 1, wherein one arm located at the one end of the core is displaceable towards and away from the other arm disposed for adaptation of the distance between the arms to the length of said core, each arm having a set of openable and closeable grippers.

3. An apparatus according to claim 2, wherien the displaceable arm is coupled to a carriage which carries the tool or tools for executing the working operations in and/or on the end of said core and is, in its turn, displaceable on rails for adaptation to the length of each one of the cores, like the corresponding carriage in the other stations, in which the carriages in the subsequent stations are arranged to adjust in compliance with the carriage in the preceding station.

4. An apparatus according to claim 3, wherein said carriage is displaceable by means of a screw which is located on substantially the same level as said rails, and proximal to the longitudinal axis of the core located in the working position.

5. An apparatus according to claim 1, whereby the stations are disposed in parallel with one another in such a manner that the distance between the center of a core fixedly held by the grippers and the center of the pivoting shaft of said arms is equal in and between the stations.

6. An apparatus according to claim 1, wherein said pivoting shaft of the arms carries a gear wheel for cooperation with a gear rack having a piston and cylinder assembly at each end, these being interconnected for positive simultaneous switching of the gear racks for clockwise or counterclockwise pivoting of the arms non-rotatably connected therewith.

7. An apparatus according to claim 1, whereby there is provided, at one station, a conveyor for the advancement of the fittings to each core end, at which there is disposed a reciprocal arm for the one-by-one displacement of the fittings from said conveyor to a staring position for rotational orientation of the fitting, an orientation in which a clamping device fixedly clamps the fitting for gripping by means of the openable and closable grippers in the oriented position.

8. An apparatus according to claim 7, wherein the grippers are mounted on a frame that is switchable between a vertical position and an inclined position, via a retainer pivotal on the frame and displaceable win the longitudinal direction of the frame, for transferring the fitting oriented in the starting position of the grippers to a position in register with the prepared core end for insertion and thereafter expansion therein by means of a mandrel.

* * * * *